US006512190B2

(12) United States Patent
Leve et al.

(10) Patent No.: US 6,512,190 B2
(45) Date of Patent: Jan. 28, 2003

(54) SAFETY DISCONNECTOR

(75) Inventors: Ludger Leve, Espelkamp (DE); Jens Krause, Rahden (DE)

(73) Assignee: Harting Automotive GmbH & Co. KG (DE)

( * ) Notice: Subject to any disclaimer, the term of this patent is extended or adjusted under 35 U.S.C. 154(b) by 0 days.

(21) Appl. No.: 09/760,675

(22) Filed: Jan. 16, 2001

(65) Prior Publication Data

US 2002/0157933 A1 Oct. 31, 2002

(30) Foreign Application Priority Data

Jan. 17, 2000 (DE) ..... 100 01 632

(51) Int. Cl.[7] ..... H01H 3/00
(52) U.S. Cl. ..... 200/506; 200/322
(58) Field of Search ..... 200/506, 322

(56) References Cited

U.S. PATENT DOCUMENTS 503,867 A * 8/1893 Matson ..... 200/506 X
4,429,201 A * 1/1984 Dekkers et al. ..... 200/506
4,609,795 A * 9/1986 Lavigne et al. ..... 200/506 X
4,647,741 A 3/1987 Belbel et al.
4,659,887 A 4/1987 Belbel et al.
4,677,266 A 6/1987 Belbel et al.

FOREIGN PATENT DOCUMENTS

DE 1 010 618 6/1957
DE 295 16 057 U1 1/1996

* cited by examiner

*Primary Examiner*—Renee Luebke
(74) *Attorney, Agent, or Firm*—Cook, Alex, McFarron, Manzo, Cummings & Mehler, Ltd.

(57) ABSTRACT

A disconnector shall be provided which along with a high degree of reliability and little structural effort enables two electric conductors to be separated from each other. To this end, a disconnector is proposed, comprising a housing (10), first and second conductors (14, 16) which extend into the housing (10) and abut against each other at a contact point (18, 20), and an adjusting element (12) adjustable between a starting position and a separating position relative to the first and second conductors (14, 16) and provided with a separating element (22) which when in its separating position separates the first and second conductors (14, 16) from each other.

9 Claims, 2 Drawing Sheets

SAFETY DISCONNECTOR

The invention relates to a safety disconnector serving for disconnecting or breaking in case of need the electric connection between two conductors. Such devices are used in particular in automotive engineering e.g. to break the connection to the vehicle battery in an accident so as to de-energize the electric circuits of the vehicle and reduce the danger of explosion. To this end, pyrotechnic disconnectors are known which use a pyrotechnic explosive charge which can be ignited in case of need and disconnects the electric connection to the vehicle battery.

It is the object of this invention to provide a disconnector which is distinguished by a particularly simple design and a high degree of reliability.

According to the invention this object is achieved by a disconnector comprising a housing, first and second conductors which extend into the housing and which abut against each other at a contact point, and an adjusting element adjustable between a starting position and a separating position relative to the first and second conductors and provided with a separating element which when in its separating position separates the first and second conductors from each other. Thus, the disconnector according to the invention effects a separation of the two conductors by strictly mechanical means, which results in minor structural effort along with minor production costs. In this connection, the separation of the two conductors can be effected in that either the separating element is inserted between the two conductors or the separating element engages one of the two conductors and lifts it off the other.

It is preferably provided that the separating element is a wedge which can be pushed between the first and second conductors in the area of the contact point. Due to the wedge effect a reliable separation of the two conductors can be achieved also with comparatively small actuation forces of the slide. At the same time, it is possible to provide structurally a comparatively long slide path for the wedge, which leads to high functional safety. Finally, it is possible to achieve self-locking in the separating position by selecting the inclination of the wedge surfaces, so that no return stop must be provided for the slide.

It is provided in an embodiment of the invention that the adjusting element is a translatorily adjustable slide which is preferably slidable approximately parallel to the direction of extension of the conductors. In this way, a simple design is obtained which results in high functional safety.

In is provided in another embodiment of the invention that the separating element is a pivot member, the pivot member being preferably pivotable about an axis approximately perpendicular to the direction of extension of the conductors. This design also leads to a simple structure which results in high functional safety.

It is preferred to provide a spring which urges the adjusting element from its starting position into its separating position, a locking element being additionally provided which can retain the adjusting element in its starting position. Also with respect to the adjustment of the slide only mechanical means are used which function with the required reliability even for a long operating time.

The locking element may be a pivotable hook. The latter may then release the slide by a simple swiveling movement, so that the slide is moved by the spring effect from the starting position into the separating position. The slide can be actuated in any way, e.g. by a magnetic switch, by a deceleration sensor sensing the exceeding of a predetermined deceleration which is characteristic of a vehicle crash or by suitable mechanical means.

As an alternative it can be provided that the locking element is a translatorily slidable buttress. This buttress can be actuated e.g. directly by a magnetic switch to release the locking element.

The spring is preferably a leaf spring one end of which is mounted on one of the conductors and the other end of which is supported on the adjusting element. In this design, the bias provided by the spring can be converted directly and without frictional losses into a displacement of the slide.

It is provided in the preferred embodiment of the invention that the leaf spring is supported on the adjusting element such that it urges one of the conductors against the other conductor. In this development, the spring has a double function: On the one hand, it urges the slide from the starting position into the separating position and, on the other hand, it urges one conductor against the other. Apart from a simpler design this results in an advantageous by-effect: when the adjusting element is transferred from the starting position into the separating position and the spring is correspondingly released, the force with which the two conductors are urged against each other is also reduced. As a result, the two conductors can be separated from each other more easily.

Advantageous embodiments of the invention are possible including various substitutions, modifications and alterations without departing from this aspect of the present invention.

The invention is described below by means of a preferred embodiment which is shown in the attached drawings, in which FIG. 1 shows a perspective sectional view of a disconnector according to a first embodiment of the invention;

Figure 1:
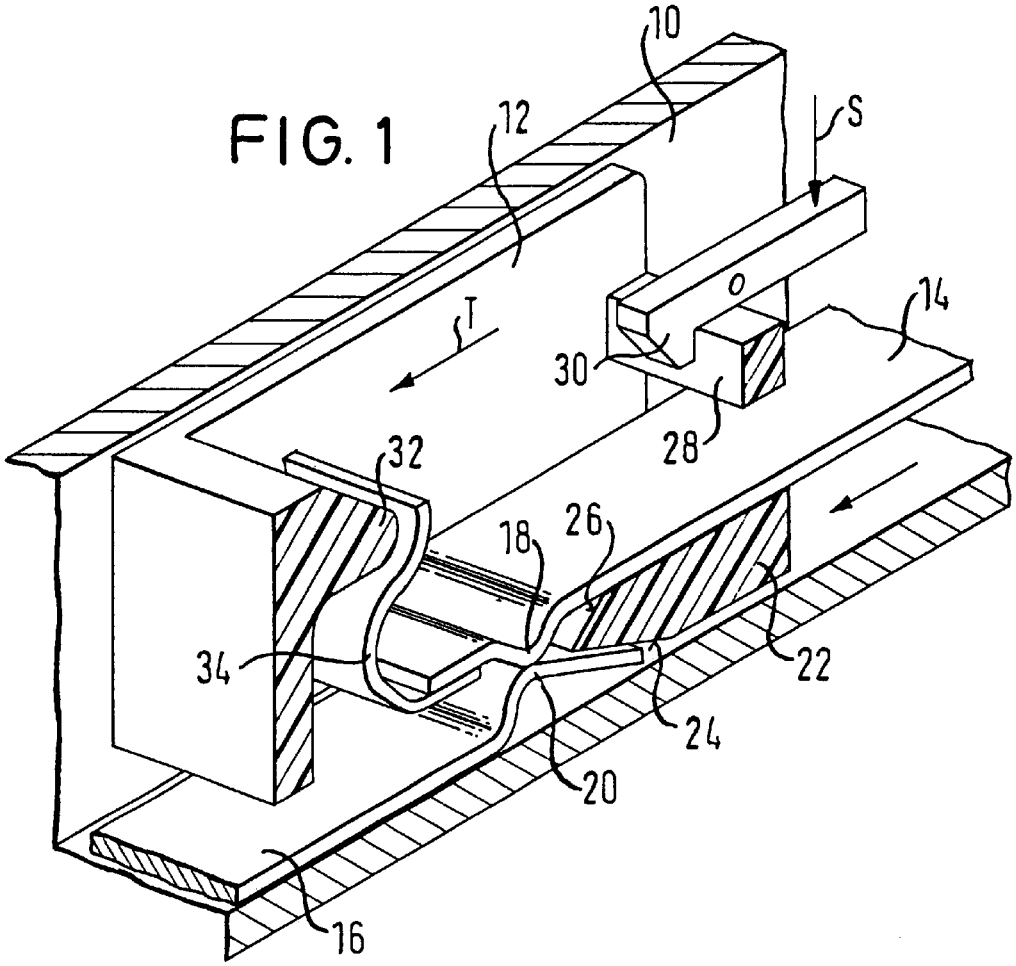
Figure 2:
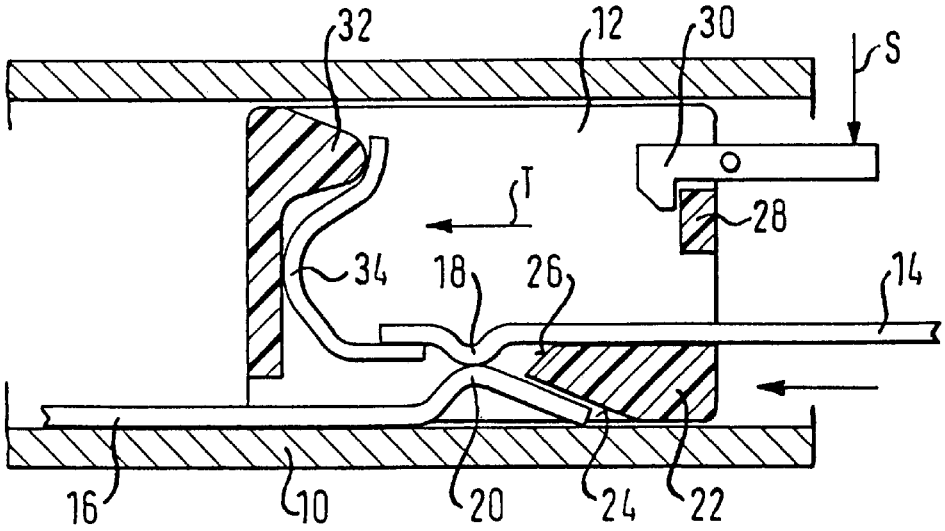
FIG. 2 shows a sectional side view of the disconnector of FIG. 1.

The disconnector shown in FIGS. 1 and 2 according to a first embodiment of the invention comprises a housing 10 shown schematically, in which an adjusting element 12 is mounted adjustably which is realized in this case as a translatorily slidable slide. Two conductors 14, 16 extend into the housing. These conductors serve for current transfer, e.g. from the vehicle battery to a consumer. Both conductors are made with a bend 18, 20 in the area of the contact point against which they abut, so that in the area of the contact point there is line-like contact. Both conductors 14, 16 are what is called flat conductors which consist of solid metal and have a rectangular cross-section. Because of the resilience of the material the conductor 14 is resiliently bendable. The conductor 16 is positioned such that it can support on the housing 10.

The slide is provided with a separating element 22 in the form of a wedge, comprising a flat ramp 24 facing the conductor 16 and a steep ramp 26 facing the conductor 14.

The slide is also provided with a locking web 28 which can be engaged by a locking element 30 in the form of a hook. The hook is pivotally supported on the housing 10, so that by performing a swiveling movement in the direction of arrow S it can be pivoted from the position shown in the Figures, in which it engages the locking web 28 and prevents displacement of the slide, into a release position.

Finally, the slide is provided with a support 32 in the form of a lug on which a bent leaf spring 34 is supported with one end. The other end of the leaf spring 34 is fixedly connected with the free end of the conductor 14, e.g. by spot welding. The leaf spring is designed and positioned such that it fulfills a double function. In the starting position of the slide shown in FIGS. 1 and 2, the spring is urged between the conductor 14 and the lug of the slide such that it urges the slide in the direction of arrow T, i.e. to the left with respect to FIG. 2. In this case, the direction given by arrow T coincides with the sliding direction of the slide and the direction of extension of the conductors 14, 16. Since the leaf spring 34 is curved and abuts against the bottom side of the lug facing the conductor 14, it simultaneously urges the conductor 14 with respect to FIG. 2 downwardly towards the conductor 16, so that an electrically well conducting contact results between the two conductors 14, 16.

In the starting position of the slide shown in FIGS. 1 and 2, a continuous electric connection is ensured from conductor 14 to conductor 16. If breaking this connection is necessary, the locking element 30 will suitably be pivoted, so that the locking web 28 of the slide is released. Then, the web is moved under the influence of the leaf spring 34 in the direction of arrow T relative to the two conductors 14, 16, and the wedge which consists of an electrically insulating material penetrates with its two ramps 24, 26 between the bends 18, 20 of the two conductors thus separating them. As a result, the electric connection between the two conductors 14, 16 is disconnected reliably.

The slide is preferably made integrally with the support 32 and the separating element 22, e.g. as an injection-molded plastic member. In this way, the electrically insulating properties of the wedge are obtained without great expense.

Figure 3:
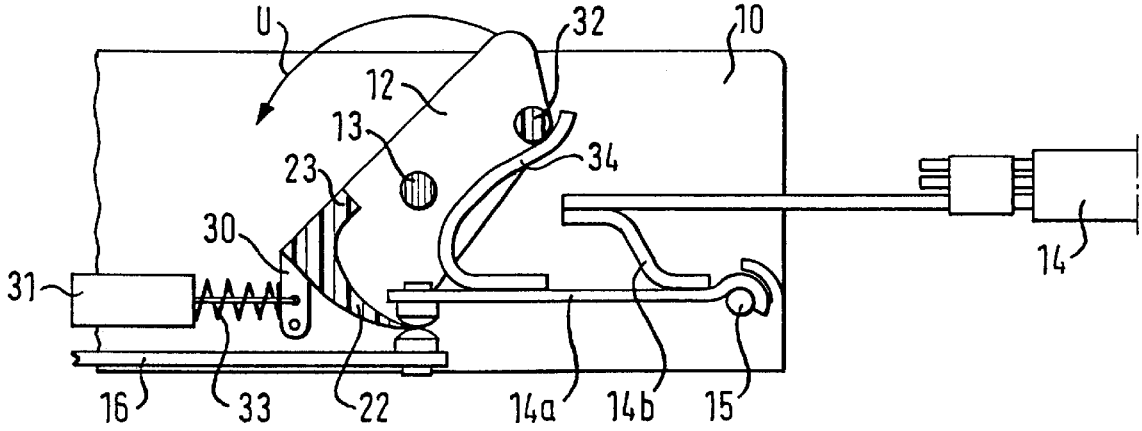
FIG. 3 shows a sectional side view of a disconnector according to a second embodiment of the invention.

FIG. 3 shows a disconnector according to a second embodiment of the invention. The same reference numbers are used for the components known already from the first embodiment, and reference is made to the above explanations.

The adjusting element 12 is made in this case as a pivot member which can be pivoted about a housing-fixed axis 13 between the starting position shown in FIG. 3 and the separating position. The separating element 22 is realized in accordance with the movement of the pivot member as a curved wedge, which at its end is provided with a stop 23.

In this embodiment, the conductor 14 which extends into the housing 10 has a pivotable section 14*a* which is guided on a bearing journal 15 at the housing 10. The pivotable section 14*a* is connected in electrically conductive manner by means of a strand 14*b* to a fixed section extending into the housing.

In the second embodiment, a buttress which can be adjusted translatorily, e.g. by an outlined magnetic switch 31 serves as a locking element 30. A return spring 33 is provided which forces the buttress against the pivot member. Thus, the buttress engages directly the pivot member and keeps it in the starting position.

The leaf spring 34 also has a double function because it urges the pivot member from its starting position into its separating position, on the one hand, and forces the two conductors against each other, on the other.

When the magnetic switch 31 is activated, the buttress is pulled to the left as regards FIG. 3. As a result, the pivot member is released, so that it makes a swiveling movement in the direction of the arrow U, through which the separating element 22 designed as a wedge is inserted between the contact point between section 14*a* of the conductor 14 and conductor 16 until the stop 23 abuts against the free end of section 14*a*. As a result, the electric connection between the two conductors is disconnected.

The pivot member is designed such that its external end can be engaged over the entire swiveling path from outside the housing, and therefore the pivot member can be returned manually from its separating position into its starting position after separating the two conductors. As a result, the disconnection can be neutralized again and the disconnector can be used again.

What is claimed is:

1. A disconnector comprising a housing 10, first and second conductors (14, 16) which extend into the housing (10) and which abut against each other at a contact point (18, 20), an adjusting element (12) adjustable between a starting position and a separating position relative to the first and second conductors (14, 16) and provided with a separating element (22) which when in its separating position separates the first and second conductors (14, 16) from each other, characterized in that a spring (34) is provided which urges the adjusting element (12) from the starting position into the separating position and that a locking element (30) is provided which can retain the adjusting element in the starting position, characterized in that the spring is a leaf spring (34), one end of which is mounted on one of the conductors(14) and the other end of which is supported on the adjusting element (12).

2. The disconnector according to claim 1, characterized in that the leaf spring (34) is supported on the adjusting element (12) such that it urges one of the conductors (14) against the other conductor (16).

3. The disconnector according to claim 1, characterized in that the separating element (22) is a wedge which in an area of the contact point can be pushed between the first and second conductors so that the wedge frictionally separates the first and second conductors.

4. The disconnector according to claim 3, characterized in that the adjusting element (12) is a translatorily adjustable slide.

5. The disconnector according to claim 4, characterized in that the slide is slidable approximately parallel to the direction of extension of the conductors (14,16).

6. The disconnector according to claim 1, characterized in that the adjusting element (12) is a pivot member.

7. The disconnector according to claim 6, characterized in that the pivot member can be pivoted about an axis (13) which is positioned approximately normal to the direction of extension of the conductors (14, 16).

8. The disconnector according to claim 1, characterized in that the locking element (30) is a pivotable hook.

9. The disconnector according to claim 1, characterized in that the locking element (30) is a translatorily slidable buttress.

* * * * *